US006684584B1

(12) United States Patent
Goldwitz

(10) Patent No.: US 6,684,584 B1
(45) Date of Patent: Feb. 3, 2004

(54) SHELTER HAVING A TENSIONED SIDEWALL ASSEMBLY

(75) Inventor: Brian L. Goldwitz, Orange, CT (US)

(73) Assignee: Tracey Goldwitz, Orange, CT (US)

( * ) Notice: Subject to any disclaimer, the term of this patent is extended or adjusted under 35 U.S.C. 154(b) by 0 days.

(21) Appl. No.: 10/031,029

(22) PCT Filed: Jul. 17, 2000

(86) PCT No.: PCT/US00/19313

§ 371 (c)(1),
(2), (4) Date: Jan. 14, 2002

(87) PCT Pub. No.: WO01/06069

PCT Pub. Date: Jan. 25, 2001

Related U.S. Application Data

(60) Provisional application No. 60/144,341, filed on Jul. 16, 1999.

(51) Int. Cl.[7] ..... E04B 1/00

(52) U.S. Cl. ..... 52/222; 52/63; 52/273; 160/180; 160/378; 135/143; 135/97; 135/144; 135/88.1

(58) Field of Search ..... 52/63, 222, 273; 160/180, 378; 135/143, 97, 144, 88.11

(56) References Cited

U.S. PATENT DOCUMENTS

| | | | | |
|---|---|---|---|---|
| 1,262,564 A | | 4/1918 | Reynolds | |
| 1,650,323 A | | 11/1927 | Byars | |
| 2,022,211 A | | 11/1935 | Leffert | |
| 2,448,895 A | | 9/1948 | Lawrence | |
| 2,493,749 A | | 1/1950 | Brown et al. | |
| 2,837,153 A | | 6/1958 | Brown et al. | |
| 2,856,941 A | | 10/1958 | O'Neal | |
| 2,865,386 A | | 12/1958 | Burns | |
| 2,905,281 A | | 9/1959 | Zitomer | |
| 2,986,150 A | | 5/1961 | Torian | |
| 3,055,380 A | | 9/1962 | Benka et al. | |
| 3,222,841 A | | 12/1965 | Lipof | |
| 3,957,069 A | | 5/1976 | Denaro | |
| 4,817,655 A | * | 4/1989 | Brooks | 135/121 |
| 5,224,306 A | | 7/1993 | Cramer | |
| 5,520,236 A | | 5/1996 | Thomas et al. | |
| 5,617,681 A | | 4/1997 | Lyons | |
| 5,800,106 A | * | 9/1998 | Miller | 410/117 |
| 5,845,423 A | * | 12/1998 | Hicks | 40/603 |
| 5,944,085 A | * | 8/1999 | Malott | 160/67 |
| 6,431,315 B1 | * | 8/2002 | Lewis | 182/92 |

* cited by examiner

*Primary Examiner*—Carl D. Friedman
*Assistant Examiner*—Steve Varner
(74) *Attorney, Agent, or Firm*—George N. Chaclas; Edwards & Angell LLP

(57) ABSTRACT

A shelter has a frame assembly (12), and a roof assembly (14) and flexible sidewall assembly (16) releasably connected thereto. The frame assembly (12) has a plurality of upright frame members (18) laterally spaced relative to each other, and a plurality of lateral frame members (20) extending laterally between and interconnecting the upright frame members (18). The flexible sidewall assembly (16) has a first sidewall frame (22), a second sidewall frame (24), and at least one flexible sidewall (26) connected at one end to the first sidewall frame (22) and connected at another end to the second sidewall frame (24) and extending therebetween. The flexible sidewall assembly (16) further has at least one tensioning device (68) connected to the flexible sidewall (26) for securing it in a taut condition to the frame assembly (12). The tensioning device (68) defines a locked position fixedly securing the flexible sidewall (26) to the frame assembly (12) in the taut condition, and an unlocked position wherein the flexible sidewall (26) is movable relative to the frame assembly (12).

26 Claims, 12 Drawing Sheets

SHELTER HAVING A TENSIONED SIDEWALL ASSEMBLY

RELATED APPLICATIONS

This application claims the benefit of U.S. Provisional Patent Application Ser. No. 60/144,341 filed Jul. 16, 1999, of Brian L. Goldwitz, the disclosure of which is herein incorporated by reference.

FIELD OF THE INVENTION

The present invention relates to shelters, and more particularly to shelters having flexible side walls that may be removed for disassembly, transportation and/or storage of the shelter.

BACKGROUND INVENTION

Collapsible structures are known in the prior art. For example, U.S. Pat. No. 2,865,386 to Burns ("the '386 Patent") shows a collapsible structure with a flexible foraminous material extended around the frame. The '386 Patent further shows a unitary sidewall flexibly fastened together by means of a strip of binding tape sewed together to connect sidewall strips. Similarly, U.S. Pat. No. 5,617,681 to Lyons shows a free-standing outdoor enclosure including a flexible skin mounted to a frame.

One drawback associated with these and other prior art shelters is the flexibility of the sidewall when assembled and connected to a supporting frame. Such flexible sidewalls are supported by the frames, and do not themselves add structural support to the shelters. In addition, such flexible sidewalls of the prior art cannot be easily wound upon themselves to facilitate transportation and storage.

Accordingly tis an object of the present invention to overcome these and other drawbacks and disadvantages of the prior art.

SUMMARY OF THE INVENTION

The present invention is directed toward a shelter comprising a frame assembly, and a roof assembly and flexible sidewall assembly releasably connected thereto. The frame assembly includes a plurality of upright frame members laterally spaced relative to each other and a plurality of lateral frame members extending laterally between and interconnecting the upright frame members. Additionally, the lateral frame members prevent the upright frame members from moving laterally relative to each other.

The flexible sidewall assembly includes a first sidewall frame, a second sidewall fame, and at least one flexible sidewall connected at one end to the first sidewall frame and connected at another end to the second sidewall frame and extending therebetween. The first and second sidewall frames are each connectable to the upright and/or the lateral frame members. The second sidewall frame is positioned laterally relative to the first sidewall frame on the frame assembly with the flexible sidewall extending therebetween.

The flexible sidewall assembly further includes at least one tensioning device connected to the flexible sidewall for securing it to the fame assembly in a taut condition. The tensioning device defines a locked position fixedly securing the flexible sidewall to the frame assembly in a taut condition, and an unlocked position wherein the flexible sidewall is movable relative to the frame assembly.

One advantage of the present invention is that the flexible sidewall assembly can be pulled taut by employing a tensioning device such that the sidewall becomes rigid. Another advantage of the present invention is that the flexible sidewall, when in a taut condition, provides additional support to the frame assembly and shelter.

Other objects and advantages of the present invention will become apparent in view of the following detailed description of the preferred embodiments and accompanying drawings.

DETAILED DESCRIPTION OF THE PREFERRED EMBODIMENTS

Figure 1:
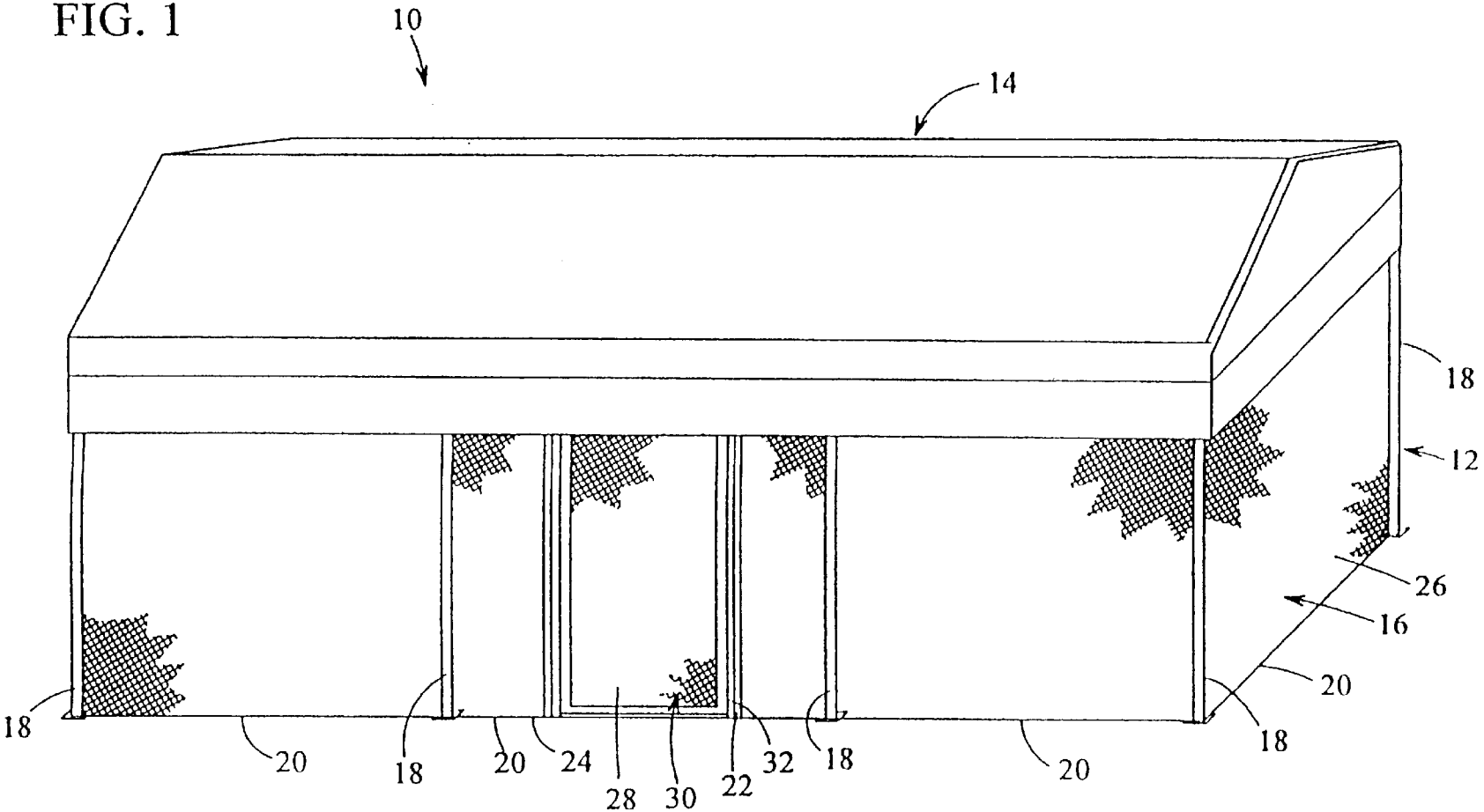
FIG. 1 is an isometric view of a shelter of the present invention.

As shown in FIG. 1, a shelter 10 of the present invention comprises a fame assembly 12, a roof assembly 14, and a flexible sidewall assembly 16. The frame assembly 12 includes a plurality of upright frame members 18 laterally spaced relative to each other, and a plurality of lower lateral frame members 20 extending laterally between and interconnecting the upright frame members 18. The lower lateral frame members 20 prevent upright frame members 18 from moving laterally relative to each other.

The flexible sidewall assembly 16 includes a first sidewall frame 22, and a second sidewall frame 24. A flexible sidewall 26 is connected at one end to the first sidewall frame 22, and is connected at another end to the second sidewall frame 24. The first sidewall frame 22 is connectable to at least one of the upright frame members 18 and lower lateral fame members 20. Similarly, the second sidewall frame 24 is connectable to at least one of the upright frame members 18 and lower lateral frame members 20, and at a position laterally spaced relative to the first sidewall frame 22, with the flexible sidewall extending therebetween. When connected to the frame assembly 12, the flexible side wall assembly 16 is pulled taut such that it additionally secures the relative positions of the frame members and prevents their disassembly. When detached from the frame assembly 12, the flexible side wall assembly 16 can be wrapped around at least one of the first and second sidewall fines 22 or 24 for transportation or storage.

As further shown in FIG. 1, the first sidewall frame 22 and second sidewall frame 24 can form a door frame assembly 28. The door frame assembly 28 includes a door panel 30 extending between the first sidewall frame 22 and second sidewall frame 24, and pivotally connected with a fastening means 32 to at least one of the first or second sidewall frames 22 or 24. As shown further in FIG. 2, the first sidewall frame 22 and the second sidewall frame 24 are each connected at one end to at least one lower lateral frame member 20, and each connected at another end to at least one upper lateral frame member 34 spaced above the lower lateral frame member 20. The first and second sidewall frames 22 and 24 are laterally spaced relative to each other to define a door opening therebetween, over which the door panel 30 can extend.

Figure 2:
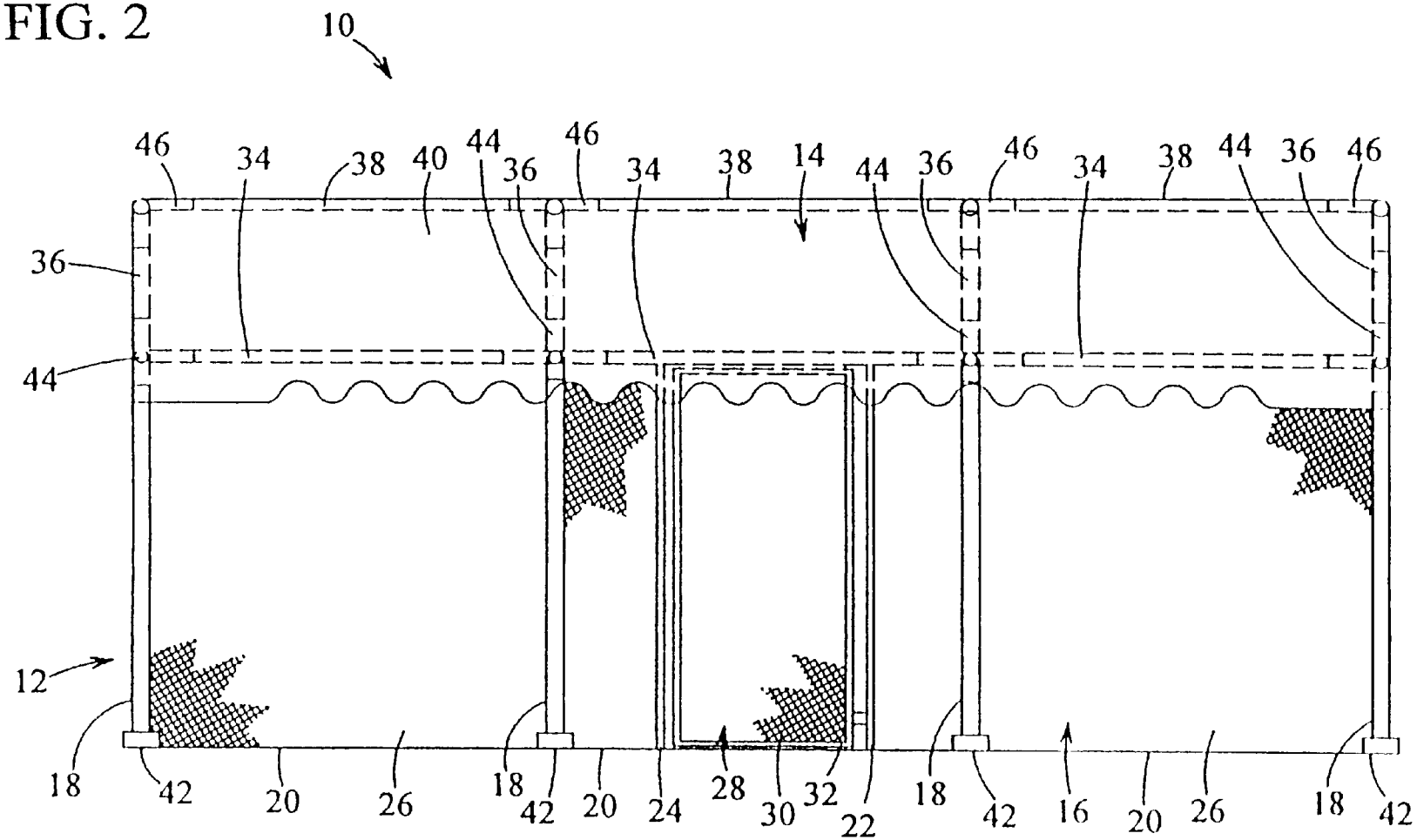
FIG. 2 is a front elevational view of the shelter of FIG. 1.

As further shown in FIG. 2, the frame assembly 12 further includes a plurality of roof frame members 36 extending from one end upwardly at an angle from the upper lateral frame members 34. The roof frame members 36 are joined at a second end to peak lateral frame members 38. In addition, the roof assembly 14 comprises a roof cover 40 extending over the frame assembly 12 and connectable thereto.

The frame assembly 12 farther includes plurality of fittings 42, 44 and 46, and each fitting interconnects adjacent frame members by receiving the ends of the frame members. As shown typically in FIG. 2, each fitting includes a plurality of female recesses for receiving therein the ends of respective fame members to interconnect the frame members and form the fame assembly. Additionally, the fittings can slidably interconnect the respective frame members such that fasteners are not required to fixedly secure the respective fame members in relation to each other.

As shown in FIG. 2, the upright frame members 18 are receivable within respective lower frame fittings 42 releaseably secured to lower lateral frame members 20. Roof frame members 36 and upper lateral frame members 34 are receivable within respective upper frame fittings 44 to thereby fixedly secure roof frame members 36 and upper lateral frame members 34 relative to each other. Similarly, roof frame members 36 and peak lateral frame members 38 are receivable within respective peak frame fittings 46 to thereby fixedly secure roof frame members 36 and peak lateral frame members 38 relative to each other.

In one embodiment of the present invention, the Same assembly members and fittings can be fabricated from rigid, durable, corrosion-resistant material, such as galvanized steel or a coated steel. The flexible sidewall 26 and door panel 30 can be fabricated from many different flexible, durable materials, such as insect netting, chain link fence, or canvas for example. Similarly, the roof cover 40 can be fabricated from a water-proof, tear-resistant material, such as canvas, to provide overhead shelter. Lastly, the fastening means 32 pivotally connecting at least one of the first and second sidewall frames 22 or 24, and the door frame assembly 28, can be one or more conventional hinges. The door panel 30 can be connected to the hinges for pivotally moving the door panel between open and closed positions.

Figure 3A:
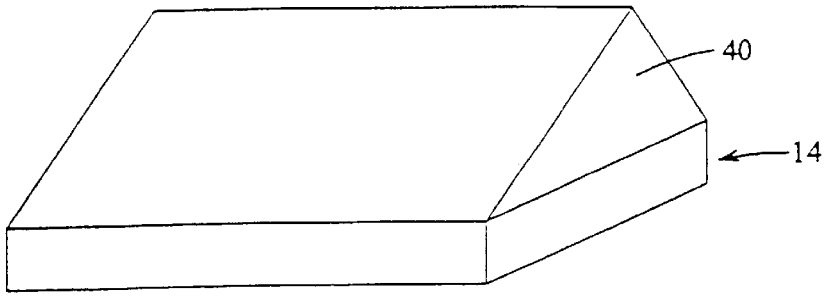
FIG. 3A is an isometric view of a roof assembly of a shelter of the present invention.
Figure 3B:
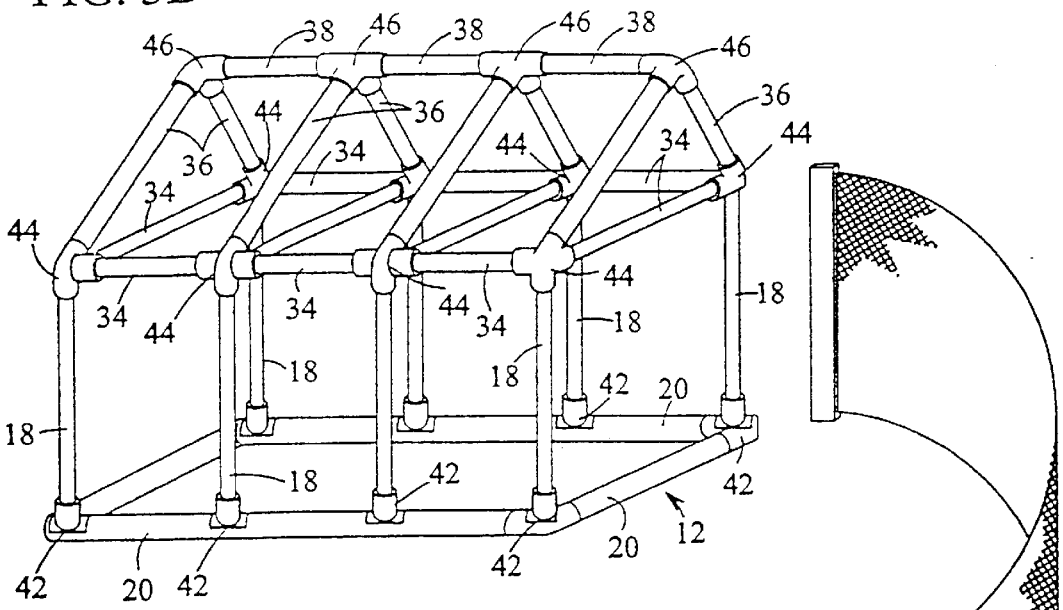
FIG. 3B is an isometric view of a frame assembly of a shelter of the present invention.
Figure 3C:
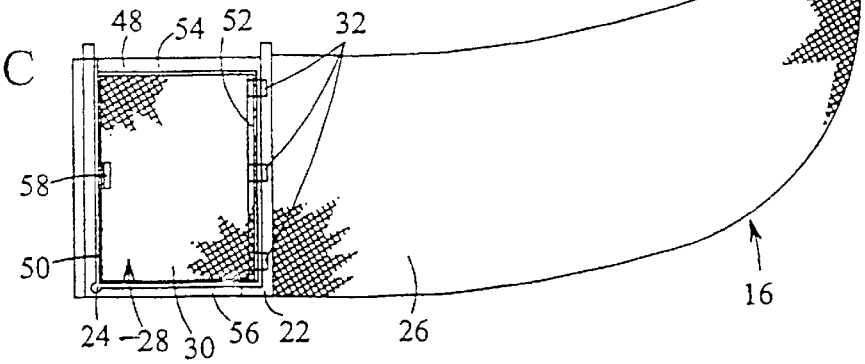
FIG. 3C is an isometric view of a flexible sidewall assembly of a shelter of the present invention.

FIGS. 3A through 3C delineate the principal assemblies of one embodiment of a shelter 10 of the present invention. In the embodiment shown in FIG. 3B, the frame assembly 12 includes eight upright frame members 18 laterally spaced relative to each other. The frame assembly 12 further includes four lower lateral frame members 20 extending laterally between and interconnecting the upright frame members 18. The upright frame members 18 are slidably received within respective lower frame female fittings 42 secured to lower lateral frame members 20.

As further shown in FIG. 3B, the frame assembly 12 includes eight roof frame members 36 extending from one end upwardly at an angle from eight upper lateral frame members 34. The roof frame members 36 and the upper lateral frame members 34 are slidably received within respective upper frame fittings 44, to thereby secure the roof frame members 36 and the upper lateral frame members 34 relative to each other. Lastly, the roof frame members 36 are joined at a second end to three peak lateral frame members 38. The roof frame members 36 and the peak lateral frame members 38 are slidably received within respective peak frame fittings 46, to thereby secure the roof frame members 36 and the peak lateral frame members 38 relative to each other. As described above, all of the frame members 18, 20, 34, 36, and 38 can be slidably removed from their respective frame fittings 42, 44, and 46 to permit disassembly of the frame assembly 12 for transportation or storage.

In the embodiment of the present invention shown in FIG. 3C, the flexible sidewall assembly 16 includes a flexible sidewall 26 extending between the first sidewall frame 22 and second sidewall frame 24 for enclosing the frame assembly 12. The first sidewall fame 22 and second sidewall frame 24 form the door frame assembly 28. The door frame assembly 28 includes a door panel 30 pivotally connected to the first sidewall frame 22 with three hinges 32. The door frame assembly 28 may further define a door frame 48 including upright frame members 50 and 52, and upper and lower lateral frame members 54 and 56 connected therebetween to form a frame for the door panel 30. In addition, the door frame assembly 28 may include a handle 58 or like means for Rasping the door frame assembly 28.

The flexible side wall assembly 16 shown detached from the frame assembly 12 in FIG. 3C is wrappable around at least one of the fist and second sidewall frames 22 or 24 for transportation or storage. Lastly, the roof assembly 14 shown in FIG. 3A rests on and is releaseably secured to the frame assembly 12 by any one of numerous conventional means such as, for example, tie-down straps.

Figure 4:
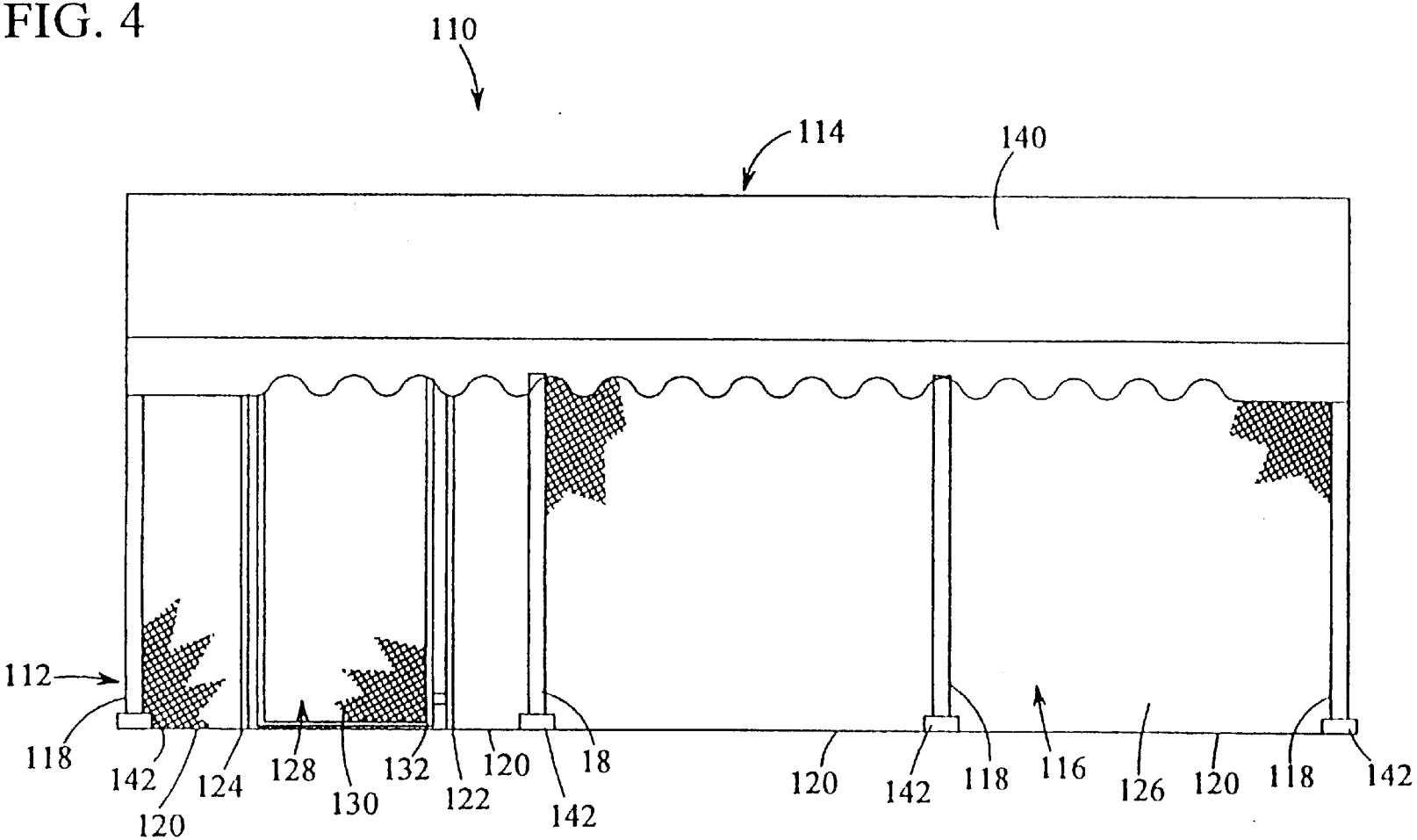
FIG. 4 is a front elevational view of a second embodiment of a shelter of the present invention.
Figure 5:
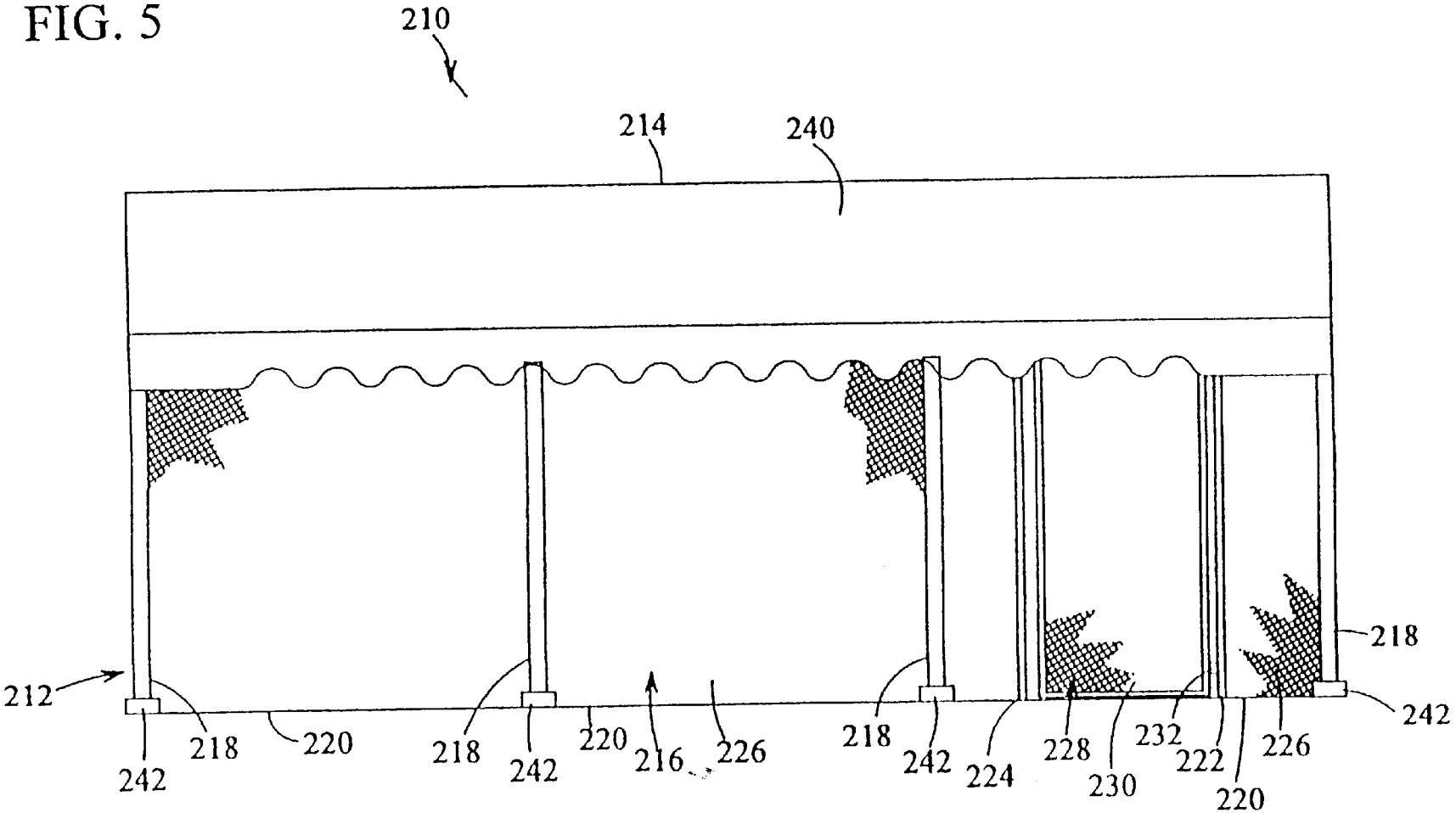
FIG. 5 is a front elevational view of a third embodiment of a shelter of the present invention.
Figure 6:
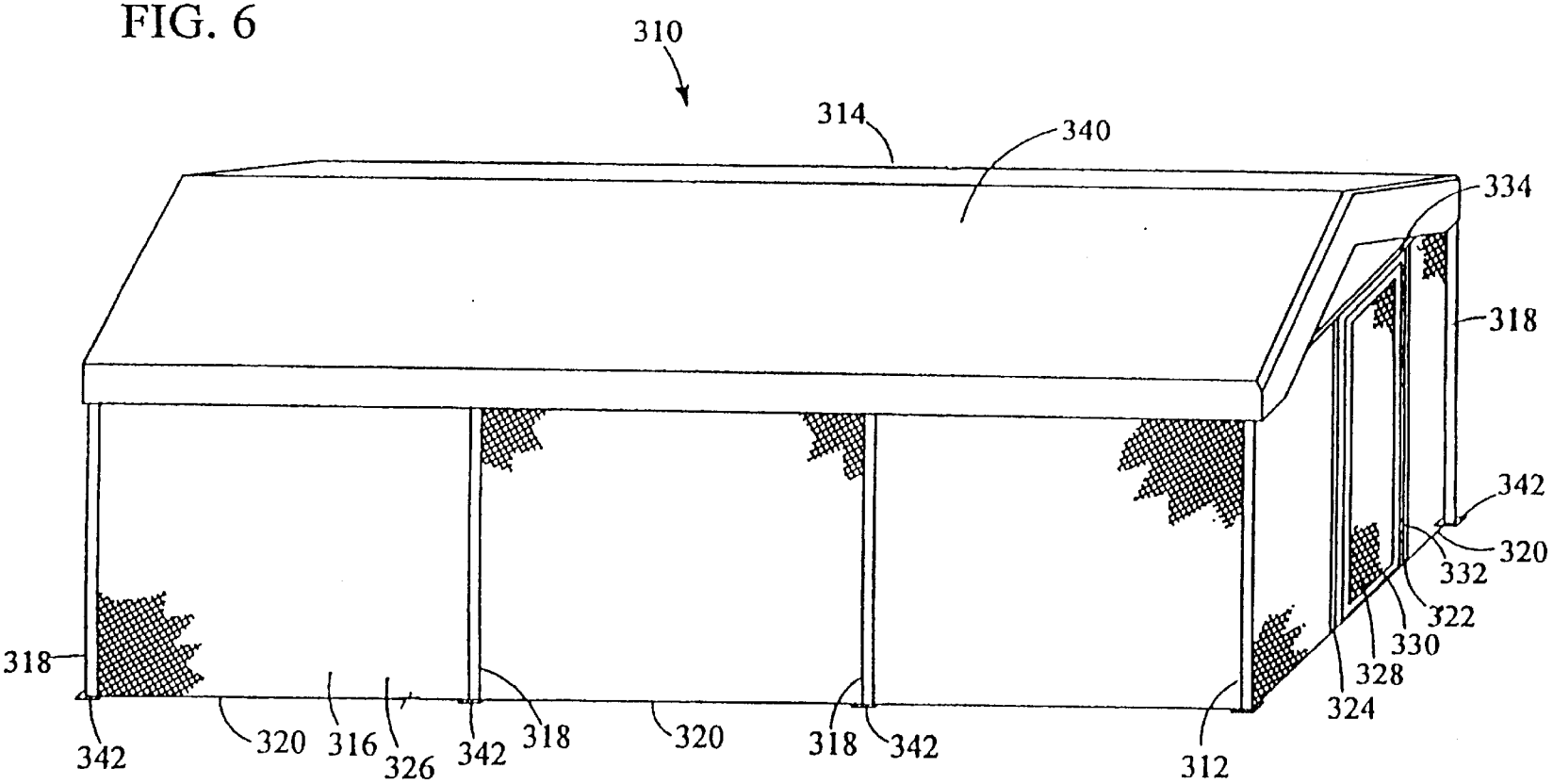
FIG. 6 is a front elevational view of a fourth embodiment of a shelter of the present invention.

Turning to FIGS. 4 through 6, three alternative configurations of the shelter 10 of the present invention are indicated generally by the respective reference numerals 110, 210, and 310. The shelters 110, 210, and 310 are each the same as the shelter 10 described above with reference to FIGS. 1 through 3, and therefore like reference numerals preceded by the respective numeral "1", "2", and "3" are used to indicate like elements. As can be seen, in FIGS. 4 through 6, one advantage of the tensioned sidewall assembly of the present invention is that the door frame assembly can be positioned at any of a plurality of different locations on the frame assembly.

As shown FIG. 4, the side wall assembly 116 can be connected to the frame assembly 112 such that the door frame assembly 128 is positioned to the left of the front side of shelter 110 in relation to the front side of shelter 10 shown in FIGS. 1 through 3. Similarly, as shown in FIG. 5, the side wall assembly 216 can be connected to the frame assembly 212 such that the door frame assembly 228 is positioned to the right of the front side of shelter 210 in relation to the front side of shelter 10 shown in FIGS. 1 through 3. Lastly, as shown in FIG. 6, the side wall assembly 316 can be connected to the frame assembly 312 such that the door frame assembly 328 is positioned on a different side of shelter 310 in relation to the front side of the shelter 10 shown in FIGS. 1 through 3.

Figure 7A:
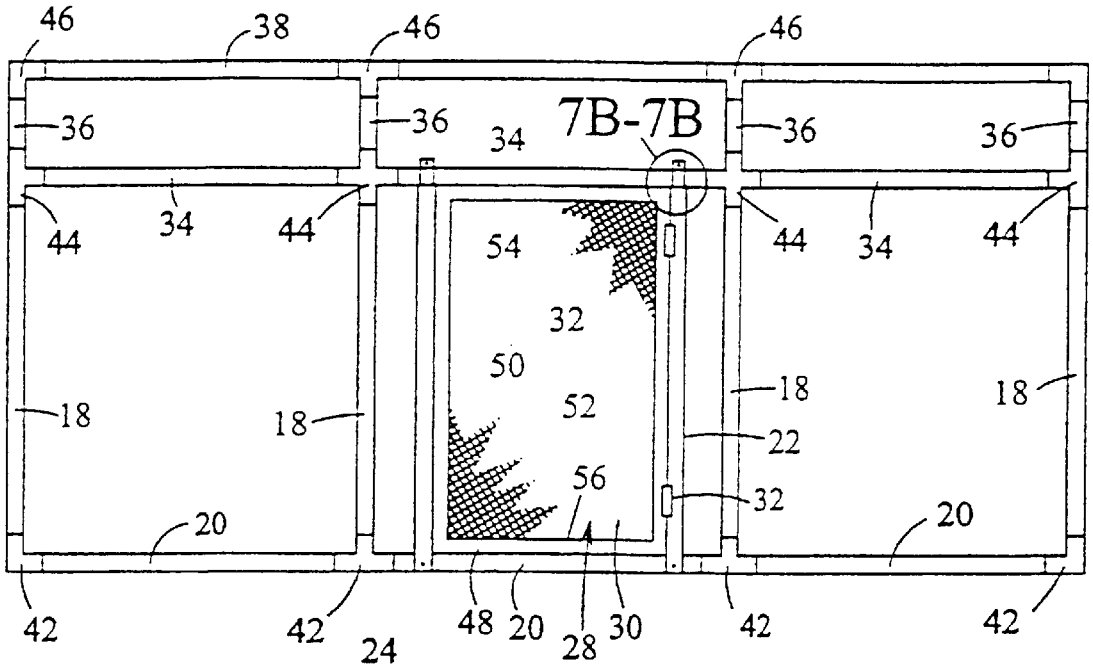
FIG. 7 is a somewhat schematic, front elevational view of a frame assembly of a shelter of the present invention.
Figure 7B:
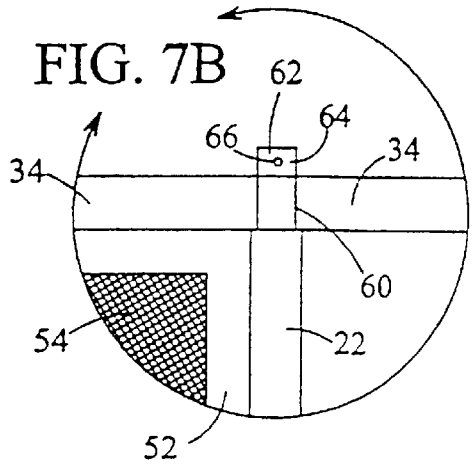

As described above in relation to the embodiment shown n FIGS. 1 through 3, and as shown in FIG. 7B, the first sidewall frame 22 of the tensioned sidewall assembly is connectable to at least one of the upright frame members 18 and lower lateral frame members 20; and the second sidewall frame 24 similarly is connectable to at least one of the upright frame members 18 and lower lateral frame members 20, and at a position laterally spaced relative to the first sidewall frame 22. One upright frame member 18 is fabricated to slidably receive a first end of each first and second sidewall frame 22 and 24, and respective lower frame fittings 42 can be fabricated to slidably receive a second end of each firs and second sidewall frames 22 and 24 to thereby connect each first and second sidewall frame 22 and 24 to at least one of the upright frame members 18 and lower lateral frame members 20.

As shown in FIG. 7A and in further detail in FIG. 7B, upper lateral frame member 34 defines an aperture 60 on one end, and a corresponding aperture 60 on the other end. In turn, a first end of each of the first and second sidewall frames 22 and 24 are slidably received into and through the apertures 60 of the upper lateral frame member 34. Similarly each of the first and second sidewall frames 22 and 24 subsequently are slidably received within pective lower frame fittings 42. In addition, the first end 62 of the first sidewall frame 22 as shown in FIG. 7B, or the first end of the second sidewall frame 24, includes an aperture 64 for receiving any one of numerous known fastening means 66, such as for example, a cotter pin, or a nut and bolt assembly.

Figure 8:
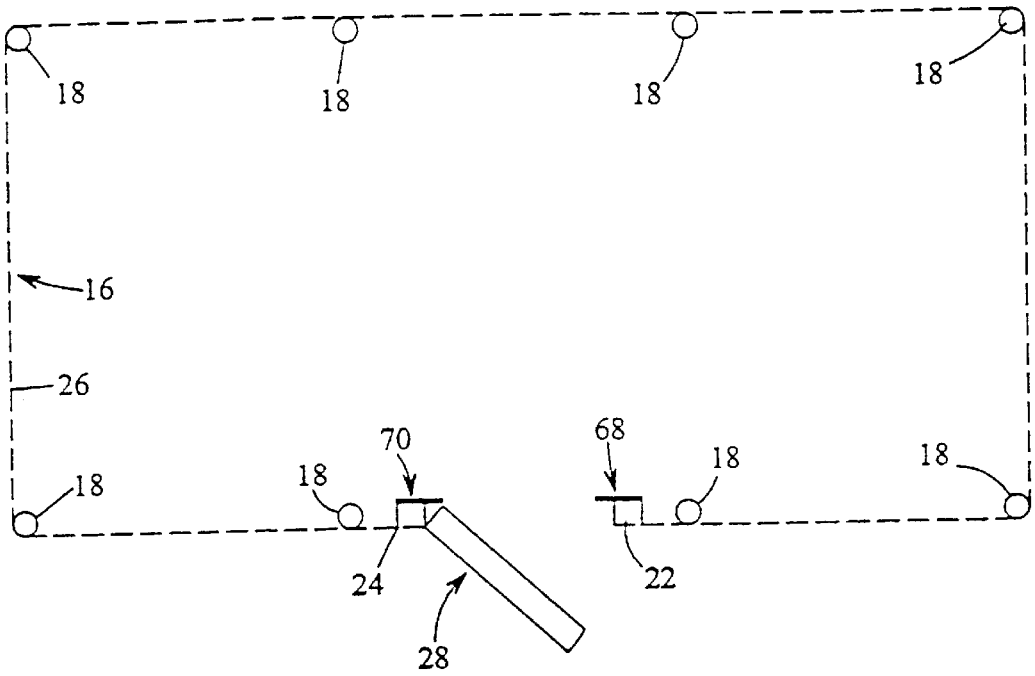
FIG. 8 is a somewhat plan view of the frame assembly of FIG. 7 with parts removed for clarity.

Turning to FIG. 8, a plan view of a shelter 10 of the present invention is provided to show the positioning of one tensioning device 68 connected to a first end of the flexible sidewall 16. The embodiment shown in FIG. 8 also includes a second tensioning device 70 connected to a second end of the flexible sidewall 16. Each tensioning device 68 or 70 can secure the flexible sidewall 16 in a taut condition to the frame assembly 12. Further, each tensioning device 68 or 70 defines a locked position fixedly securing the flexible sidewall 16 to the frame assembly 12 in a taut condition, and an unlocked position wherein the flexible sidewall 16 is movable relative to the frame assembly 12.

Figure 9:
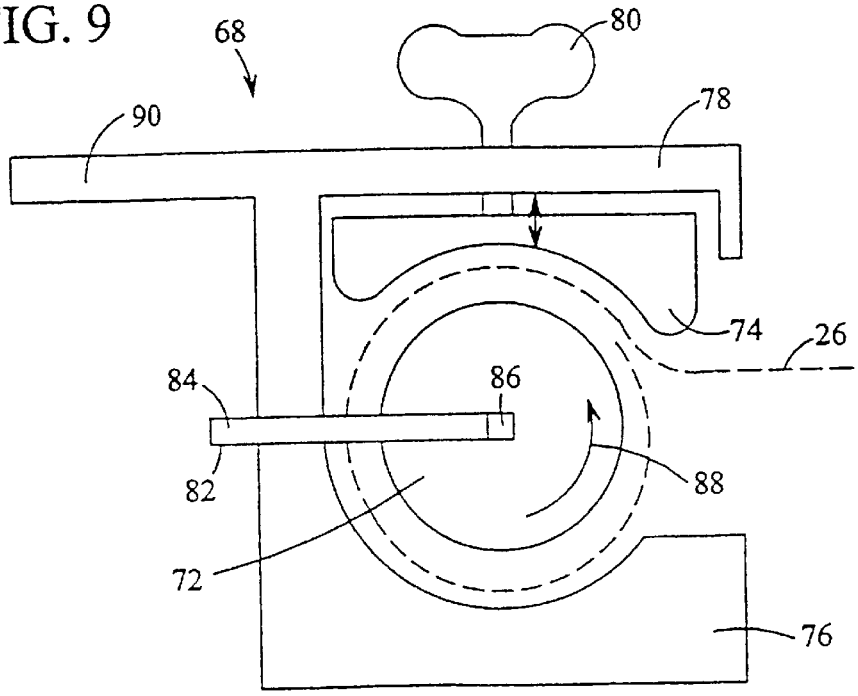
FIG. 9 is a somewhat schematic, top plan view of a tensioning device of the flexible sidewall assembly of the shelter of FIGS. 7 and 8.

As shown in FIG. 9, the tensioning device 68 includes a roller 72, wherein one end of the flexible sidewall 26 can be wrapped over the roller. Generally, the roller 72 is approximately cylindrical as shown in FIG. 9. The tensioning device 68 further includes a locking member 74 which, as indicated by the arrows in FIG. 9, is movable relative to the roller 72 between a locked position engaging the flexible sidewall 26 and fixedly securing the flexible sidewall 26 in a taut condition; and an unlocked position spaced relative to the roller 72 and allowing the roller 72 and flexible sidewall 26 to move relative to the locking member 74. In addition, the tensioning device includes a housing 76 such that the roller 72 is rotatably mounted within the housing 76, and the locking member 74 is connected between a housing sidewall 78 of the housing 76 and the roller 72.

As further shown in FIG. 9 the tensioning device 68 also includes a threaded member 80 in the form of a thumb screw threadedly connected between the locking member 74 and housing 76. The locking member 74 is movable between the locked and the unlocked positions upon threadedly rotating the threaded member 80 relative to the housing 76. Lastly, the tensioning device 68 includes means 82 connectable to the roller 72 for rotating the roller 72 and, in turn, winding the flexible sidewall 26 on the roller 72

In one embodiment of the invention and as shown in FIG. 9, the means 82 connectable to the roller 72 for rotating the roller 72 can include a tool 84, such as an appropriately shaped wrench, and a corresponding aperture 86 formed in an end wall 88 of the roller 72. The tool 84 can be slidably received within the aperture 86 such that the roller 72 can be rotated to thereby wind the flexible sidewall 26 on the roller 72. As further shown in FIG. 9, the housing sidewall 78 of the housing 76 can be fabricated to additionally form a door stop 90 of the door frame assembly 28.

Figure 10:
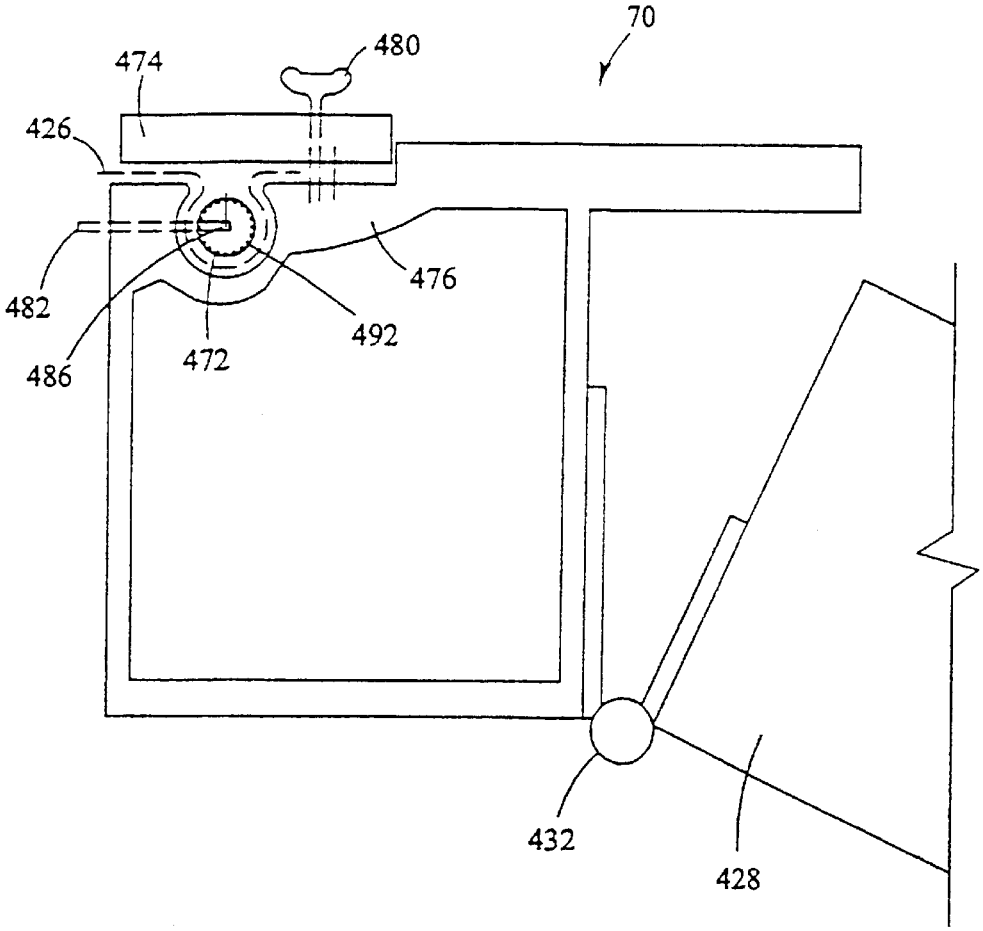
FIG. 10 is a somewhat schematic top plan view of another tensioning device of the flexible sidewall assembly of the shelter of FIGS. 7 and 8.

As shown in FIG. 10, a corresponding tensioning device 70 can be provided to fixedly secure a second end of the flexible sidewall 26. The tensioning device 70 is essentially the same as the tensioning device 68 described above with reference to FIG. 9, and therefore like reference numerals preceded by the numeral "4" are used to indicate like elements. As can be seen, a primary difference of the tensioning device 70 is that the locking member 474 is located adjacent to the housing 476 rather than in between the housing 76 and the roller 72.

As shown in FIG. 10, the tensioning device 70 includes a roller 472, rotatably mounted within the housing 476, wherein one end of the flexible sidewall 426 can be fixedly secured over the roller 472. In the embodiment of the present invention shown in FIG. 10, the roller surface 492 can define a plurality of recessed surface areas and adjacent raised surface areas that are engagable with the flexible sidewall 426 for facilitating securing the flexible sidewall 426 on the roller 472. The tensioning device 70 further includes a locking member 474 movable relative to the roller 472 and the housing 474 between a locked position engaging the flexible sidewall 426 and fixedly securing the flexible sidewall 426 in a taut condition; and an unlocked position spaced relative to the roller 472 and the housing 474 and allowing the roller 472 and flexible sidewall 426 to move relative to the locking member 474.

As further shown in FIG. 10, the tensioning device 70 also includes a threaded member 480, such as a thumb screw, threadedly connected between the locking member 474 and housing 476. The locking member 474 is movable between the locked and the unlocked positions upon threadedly rotating the threaded member 480 relative to the housing 476. Lastly, the tensioning device 70 includes means 482 connectable to the roller 472 for rotating the roller 472 and, in turn, fixedly securing the flexible sidewall 426 on the roller 472.

In a preferred embodiment of the present invention, the housing 76 of the tensioning device 68 can be formed by the first sidewall frame 22 of the flexible sidewall assembly 16.

Similarly, the housing 476 of the tensioning device 70 can be formed by the second sidewall frame 24 of the flexible sidewall assembly 16.

Figure 11:
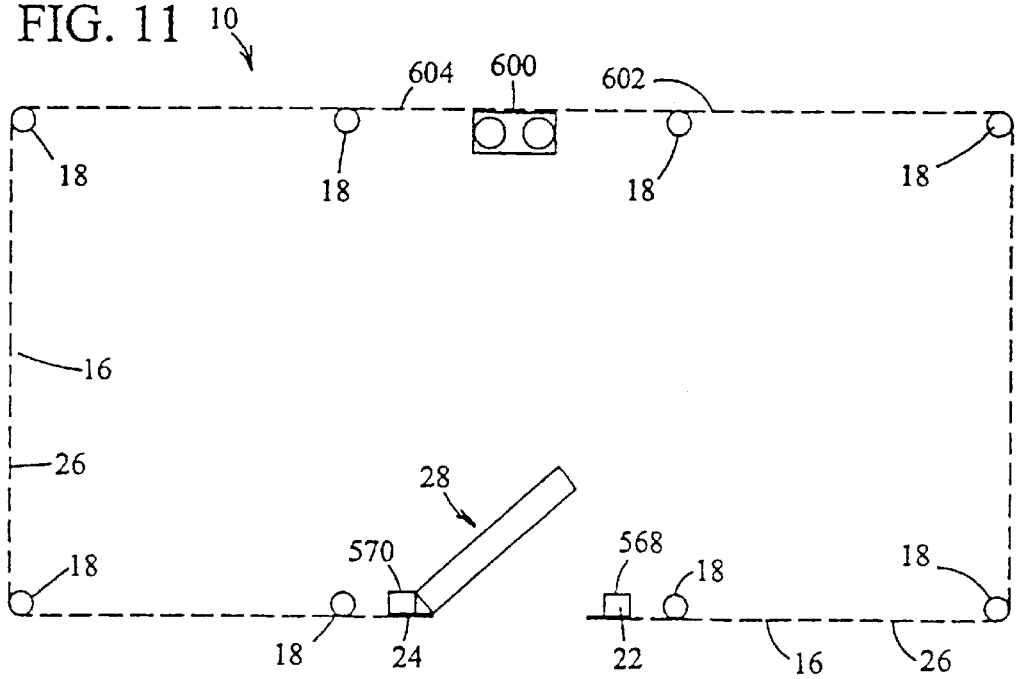
FIG. 11 is a somewhat schematic, top plan view of another embodiment of a shelter of the present invention wherein the door opens inwardly.

Turning to FIG. 11, a plan view of another embodiment of a shelter 10 of the present invention is provided to show an alternative arrangement of the door frame assembly 28 such that the door frame assembly 28 opens inwardly. The tensioning devices 568 and 570 are essentially the same as the tensioning devices 68 and 70 described above with reference to FIGS. 9 and 10, and therefore like reference numerals precede by the numeral "5" are used to indicate like elements in FIGS. 11, 12, and 13.

Figure 12:
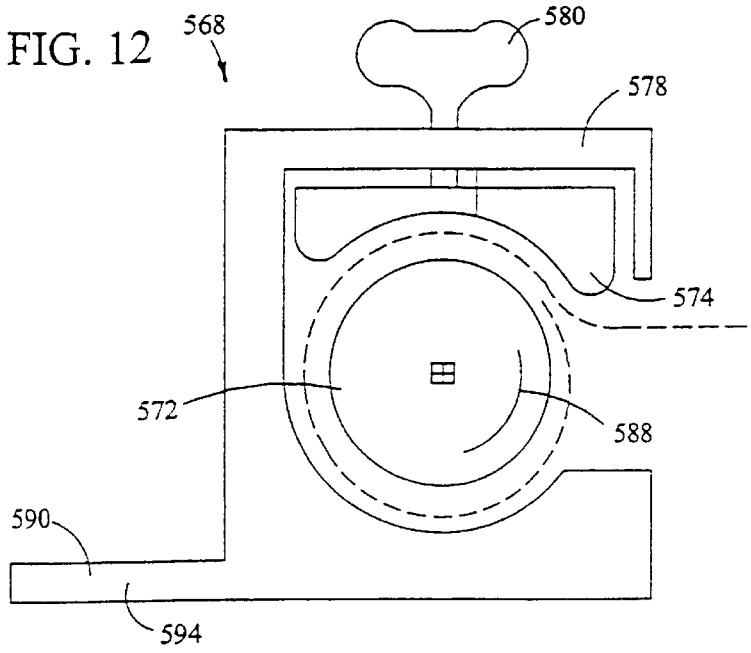
FIG. 12 is a somewhat schematic, top plan view of another embodiment of the tensioning device of the flexible sidewall assembly of the shelter of FIG. 11.
Figure 13:
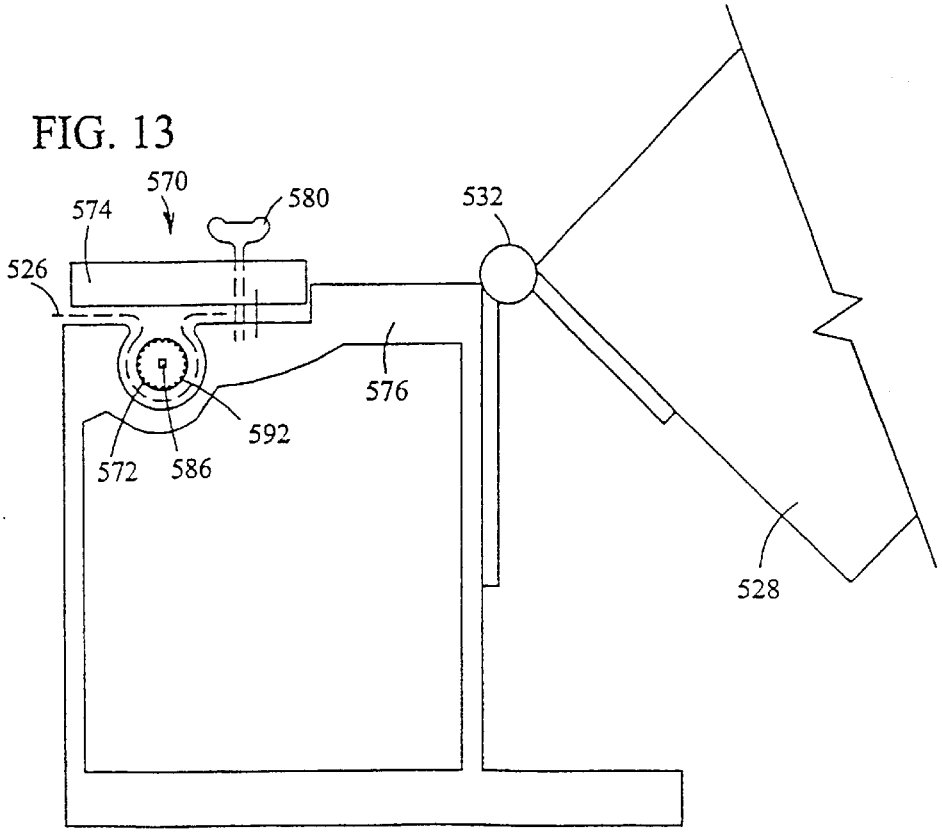
FIG. 13 is a somewhat schematic, top plan view of another embodiment of a tensioning device of the flexible sidewall assembly of the shelter of FIG. 11.

As shown in FIG. 12, the tensioning device 568 is essentially the same as the tensioning device 68 described above. However, in order for the housing 576 to similarly form a doorstop 590, the housing 576 includes a second housing sidewall 594 as shown in FIG. 11. Similarly, the tensioning device 570 is essentially the same as the tensioning device 70 described above. Again, in order for the housing 570 to similarly form a doorstop 590, the housing 576 includes a second housing sidewall 596 as shown in FIG. 13.

As further shown in FIG. 11, a shelter 10 of the present invention may alternatively comprise first and second flexible side walls 602 and 604. The first flexible side wall 602 is connected on one end to the first sidewall frame 22, and the second flexible side wall. 604 is connected on one end to the second sidewall Same 24. The flexible sidewall assembly 16 further comprises a sidewall connector assembly 600 connected to the other ends of the first and second flexible sidewalls 602 and 604 to thereby interconnect the flexible sidewalls 602 and 604.

Figure 14:
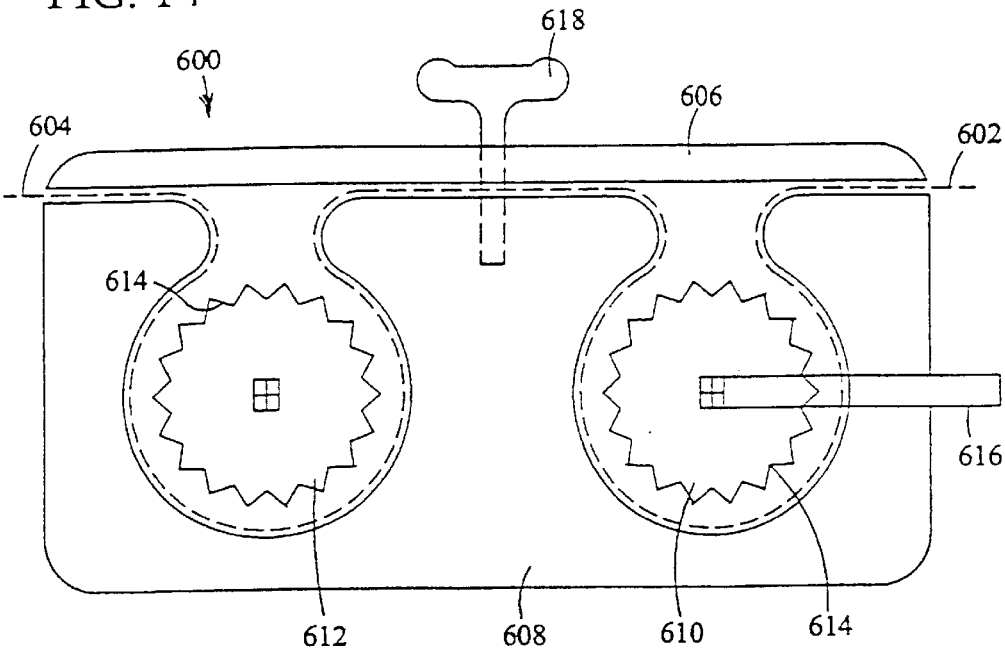
FIG. 14 is a somewhat schematic, top plan view of a connection assembly of the flexible sidewall assembly of the shelter of FIG. 11.

As shown in detail in FIG. 14, the connector assembly 600 includes at least one locking member 606, and as indicated by the arrows, the locking member is movable between a locked position and an unlocked position. In the locked position, the locking member 606 engages the respective end of a first and second flexible sidewall 602 or 604 to fixedly secure the flexible sidewall thereto. In the unlocked position, the locking member 606 is spaced away from the respective flexible sidewall 602 or 604 to release the sidewall therefrom.

As further shown in FIG. 14, the connector assembly 600 includes a housing 608, and at least one roller 610, and preferably a second roller 612, rotatably mounted within the housing 608. One end of a respective flexible sidewall 602 or 604 can be wrapped against a roller 610 or 612 to wind the flexible sidewall onto the roller, and to release the flexible sidewall therefrom. Each roller 610 and 612 further includes a roller surface 614 and a means 616 connectable to the rollers for rotating the rollers and fixedly securing the flexible sidewall 602 or 604, all as described above. In addition, the connector assembly 600 includes a threaded member 618 threadedly connected between the locking member 606 and housing 608. As described above, the locking member 606 is movable between the locked and the unlocked positions upon threadedly rotating the threaded member 618 relative to the housing 608.

Figure 15:
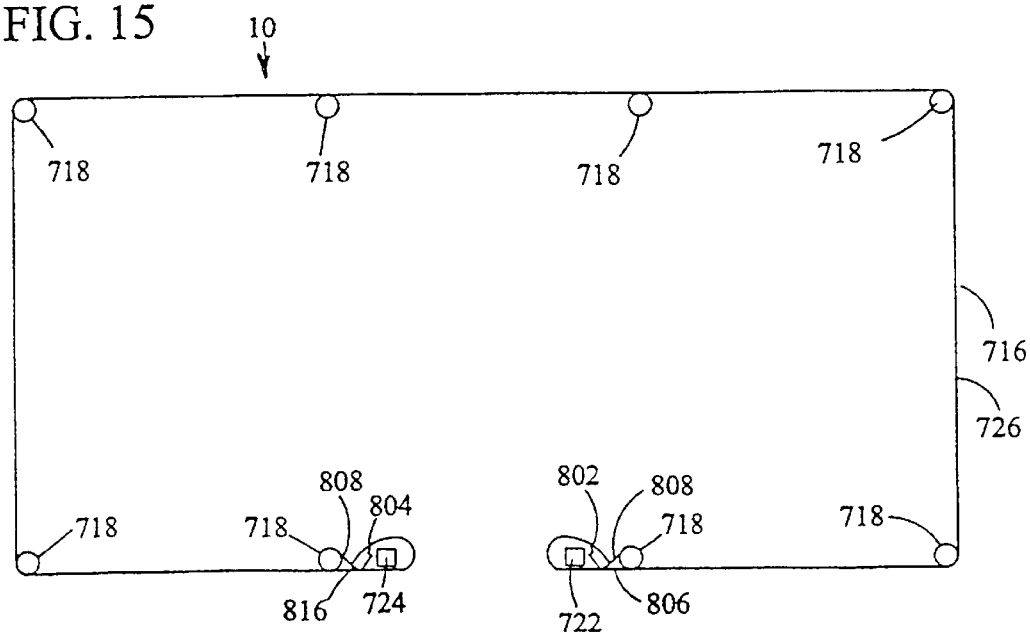
FIG. 15 is a somewhat schematic, top plan view of another embodiment of a shelter of the present invention with parts removed for clarity.

Another embodiment of a shelter of the present invention is shown in FIG. 15, and as the shelter is essentially the same as the shelter described above in connection with FIGS. 1 through 3, like reference numerals preceded by the numeral "7" are used to indicate like elements. As shown in FIG. 15, shelter 710 includes a flexible sidewall assembly 716 that further includes at least one elongated pocket 802 on at least one end thereof, and preferably a second elongated pocket 804 on the other end thereof. The first and second sidewall frames 722 and 724 are each received within a respective elongated pocket 802 or 804.

A tensioning device 806 is connected to the flexible sidewall 726, and receives a strap 808 connected to an upright frame member 718. By pulling the strap 808 through the tensioning device 806, tension is applied to the flexible sidewall 726.

Figures 16A, 16B:
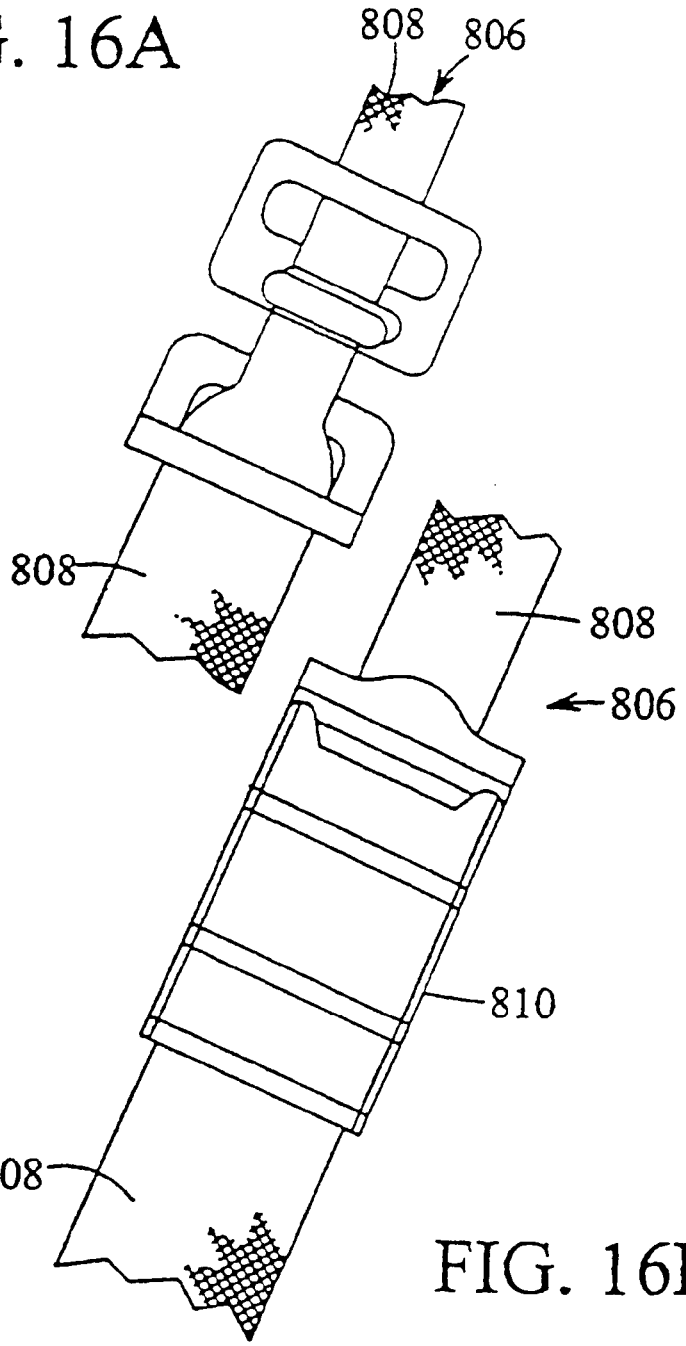
FIGS. 16A and 16B are isometric views of two alternative adjustable buckles used the in tensioning device of the flexible sidewall assembly of the shelter of the of FIG. 15.

As may be recognized by those skilled in the pertinent art based on the teachings herein, any of the tensioning devices employed in a shelter of the present invention may take any of numerous different shapes, configurations, and/or types of such tensioning devices that are currently or later become known for performing the functions of the tensioning device assemblies described herein. For example, a tensioning device 806 alternatively can comprise an adjustable buckle 806 as shown in FIG. 16A and 16B. At least one strap 808 can connect the adjustable buckle 806 between a respective end of the flexible sidewall 726 and an upright frame member 718 to thereby adjustably connect the flexible sidewall assembly 716 to the frame assembly. The adjustable buckle can be any one of numerous embodiments known such as a spring-loaded buckle 812 shown in FIG. 16A, or a double bar buckle 810 shown in FIG. 16B.

One advantage of the flexible sidewall assembly described in connection with a shelter of the present invention is that when it is pulled taut, the side wall assembly effectively secures the frame assembly members and prevents their disassembly Another advantage of the flexible sidewall assembly is that a shelter can be fully assembled and secured without the use of fasteners, and be as effectively secured as if fasteners were employed.

As may be recognized by those skilled in the pertinent art based on the teachings herein, numerous other changes and modifications may be made to the above-described and other embodiments of the present invention without departing from its scope as defined in the appended claims. Accordingly, this detailed description of preferred embodiments is to be taken in an illustrative, as opposed to a limiting sense.

What is claimed is:

1. A shelter, comprising:

a frame assembly including (i) a plurality of upright frame members laterally spaced relative to each other, and (ii) a plurality of lateral frame members extending laterally between and interconnecting the upright frame members, and preventing the upright frame members from moving laterally relative to each other;

a roof extending over the frame assembly and connectable thereto;

a flexible sidewall assembly including (i) a first sidewall frame, (ii) a second sidewall frame, and (iii) at least one flexible sidewall connected at one end to the first sidewall frame and connected at another end to the second sidewall frame and extending therebetween, wherein the first sidewall frame is connectable to at least one of the upright and lateral frame members, and the second sidewall frame is connectable to at least one of the upright and lateral frame members at a position laterally spaced relative to the first sidewall frame on the frame assembly with the flexible sidewall extending therebetween, and wherein the first and second sidewall frames are detachable from the flexible sidewall assembly, and the at least one flexible sidewall is wrappable around at least one of the first and second sidewall frames for at least one of transportation and storage; and at least one tensioning device connected to at least one end of the flexible sidewall for securing the at least one flexible sidewall in a taut condition to the frame assembly, wherein the tensioning device defines (i) a locked position fixedly securing the flexible sidewall to the frame assembly in a taut condition, and (ii) an unlocked position wherein the flexible sidewall is movable relative to the frame assembly.

2. A shelter as defined in claim 1, wherein the first and second sidewall frames form a door frame assembly, with the first and second sidewall frames each connected at one end to at least one first lateral frame member and each connected at another end to at least one second lateral frame member spaced below the first lateral frame member, and wherein the first and second sidewall frames are laterally spaced relative to each other to define a door opening therebetween.

3. A shelter as defined in claim 2, further comprising a door panel extending between the first and second sidewall frames.

4. A shelter as defined in claim 3, further comprising at least one hinge connectable to at least one of the first and second sidewall frames, and wherein the door panel is connected to the hinge for pivotally moving the door panel between open and closed positions.

5. A shelter as defined in claim 2, wherein the flexible sidewall assembly encloses the frame assembly.

6. A shelter as defined in claim 5, wherein the flexible sidewall assembly includes a single flexible sidewall extending between the first and second sidewall frames and enclosing the frame assembly.

7. A shelter as defined in claim 1, wherein the tensioning device includes a roller with one end of the flexible sidewall wrapped over the roller, and a locking member movable relative to the roller between (i) a locked position engaging the flexible sidewall and fixedly securing the sidewall in a taut condition, and (ii) an unlocked position spaced relative to the roller and allowing the roller and flexible sidewall to move relative to the locking member.

8. A shelter as defined in claim 7, wherein the tensioning device further includes a housing, the roller is rotatably mounted within the housing, and the locking member is connected between a sidewall of the housing and the roller.

9. A shelter as defined in claim 8, wherein the tensioning device further includes a threaded member threadedly connected between the locking member and housing, and wherein the locking member is movable between the locked and the unlocked positions upon threadedly rotating the threaded member relative to the housing.

10. A shelter as defined in claim 9, wherein the housing is formed by one of the first and second sidewall frames.

11. A shelter as defined in claim 7, further including means connectable to the roller for rotating the roller and, in turn, winding the flexible sidewall on the roller.

12. A shelter as defined in claim 7, wherein the roller is approximately cylindrical.

13. A shelter as defined in claim 7, wherein the roller defines a plurality of recessed surface areas and adjacent raised surface areas engagable with the flexible sidewall for facilitating winding the flexible sidewall on the roller.

14. A shelter as defined in claim 1, wherein the flexible sidewall includes an elongated pocket on at least one end thereof, and at least one of the first and second sidewall frames is received within a respective elongated pocket.

15. A shelter as defined in claim 1, wherein the tensioning device includes an adjustable buckle and at least one strap connecting the adjustable buckle between a respective end of the flexible sidewall and the frame assembly to thereby adjustably connect the flexible sidewall to the frame assembly.

16. A shelter as defined in claim 15, wherein the adjustable buckle is a double bar buckle.

17. A shelter as defined in claim 15, wherein the adjustable buckle is a spring-loaded buckle.

18. A shelter as defined in claim 1, wherein the fame assembly includes a plurality of fittings, and each fitting interconnects the lateral and upright frame members by receiving one of a fitting and fame member in the other of the fitting and frame member.

19. A shelter as defined in claim 18, wherein each fitting includes a plurality of female recesses for receiving therein the ends of the respective lateral and upright frame members to interconnect the frame members and form the frame assembly.

20. A shelter as defined in claim 18, wherein the fittings slidably interconnect the lateral and upright frame members without fasteners.

21. A shelter as defined in claim 18, wherein the flexible sidewall in the taut condition secures the relative positions of the lateral and upright frame members and prevents their disassembly.

22. A shelter, comprising:

a frame assembly including (i) a plurality of upright frame members laterally spaced relative to each other, and (ii) a plurality of lateral frame members extending laterally between and interconnecting the upright frame members, and preventing the upright frame members from moving laterally relative to each other;

a roof extending over the frame assembly and connectable thereto;

a flexible sidewall assembly including (i) a first sidewall frame, (ii) a second sidewall frame, and (iii) at least one flexible sidewall connected at one end to the first sidewall frame and connected at another end to the second sidewall frame and extending therebetween, wherein the first sidewall frame is connectable to at least one of the upright and lateral frame members, and the second sidewall frame is connectable to at least one of the upright and lateral frame members at a position laterally spaced relative to the first sidewall frame on the frame assembly with the flexible sidewall extending therebetween;

at least one tensioning device connected to at least one end of the flexible sidewall for securing the at least one flexible sidewall in a taut condition to the frame assembly, wherein the tensioning device defines (i) a locked position fixedly securing the flexible sidewall to the frame assembly in a taut condition, and (ii) an unlocked position wherein the flexible sidewall is movable relative to the frame assembly;

first and second flexible side walls, wherein the first flexible side wall is connected on one end to the first sidewall frame, the second flexible side wall is connected on one end to the second sidewall frame; and a sidewall connector assembly connected to the other ends of the first and second flexible side walls to thereby interconnect the flexible side walls.

23. A shelter as defined in claim 22, wherein the connector assembly includes at least one locking member movable between a locked position engaging the respective end of at least one of the first and second flexible sidewalls to fixedly secure the flexible sidewall thereto, and an unlocked position spaced away from the respective sidewall to release the sidewall therefrom.

24. A shelter as defined in claim 23, wherein the connected assembly includes a housing, and at least one roller rotatably mounted within the housing, wherein one end of a respective flexible side wall is wrapped against the roller to wind the flexible sidewall onto the roller, and to release the flexible sidewall therefrom.

25. A shelter, comprising:

a frame assembly including (i) a plurality of upright frame members laterally spaced relative to each other, and (ii) a plurality of lateral frame members extending laterally between and interconnecting the upright frame members, and preventing the upright frame members from moving laterally relative to each other;

a roof extending over the frame assembly and connectable thereto;

a flexible sidewall assembly including (i) a first sidewall frame, (ii) a second sidewall frame, and (iii) at least one flexible sidewall connected at one end to the first sidewall frame and connected at another end to the second sidewall frame and extending therebetween, wherein the first sidewall frame is connectable to at least one of the upright and lateral frame members, and the second sidewall frame is connectable to at least one of the upright and lateral frame members at a position laterally spaced relative to the first sidewall frame on the frame assembly with the flexible sidewall extending therebetween, wherein the first and second sidewall frames form a door frame assembly, with the first and second sidewall frames each connected at one end to at least one first lateral frame member and each connected at another end to at least one second lateral frame member spaced below the first lateral frame member, and wherein the first and second sidewall frames are laterally spaced relative to each other to define a door opening therebetween;

at least one tensioning device connected to at least one end of the flexible sidewall for securing the at least one flexible sidewall in a taut condition to the frame assembly, wherein the tensioning device defines (i) a locked position fixedly securing the flexible sidewall to the frame assembly in a taut condition, and (ii) an unlocked position wherein the flexible sidewall is movable relative to the frame assembly;

a door panel extending between the first and second sidewall frames; and at least one hinge connectable to at least one of the first and second sidewall frames, and wherein the door panel is connected to the hinge for pivotally moving the door panel between open and closed positions.

26. A shelter, comprising:

a frame assembly including (i) a plurality of upright frame members laterally spaced relative to each other, and (ii) a plurality of lateral frame members extending laterally between and interconnecting the upright frame members, and preventing the upright frame members from moving laterally relative to each other;

a roof extending over the frame assembly and connectable thereto;

a flexible sidewall assembly including (i) a first sidewall frame, (ii) a second sidewall frame, (iii) at least one flexible sidewall connected at one end to the first sidewall frame and connected at another end to the second sidewall frame and extending therebetween, wherein the first sidewall frame is connectable to at least one of the upright and lateral frame members, and the second sidewall frame is connectable to at least one of the upright and lateral frame members at a position laterally spaced relative to the first sidewall frame on the frame assembly with the flexible sidewall extending therebetween, and (iv) a plurality of fittings, and each fitting interconnects the lateral and upright frame members by receiving one of a fitting and frame member in the other of the fitting and frame member, wherein each fitting includes a plurality of female recesses for receiving therein the ends of the respective lateral and upright frame members to interconnect the frame members and form the frame assembly and the fittings slidably interconnect the lateral and upright frame members without fasteners; and at least one tensioning device connected to at least one end of the flexible sidewall for securing the at least one flexible sidewall in a taut condition to the frame assembly, wherein the tensioning device defines (i) a locked position fixedly securing the flexible sidewall to the frame assembly in a taut condition, and (ii) an unlocked position wherein the flexible sidewall is movable relative to the frame assembly.

* * * * *